United States Patent [19]

Lederman

[11] Patent Number: 4,781,374

[45] Date of Patent: Nov. 1, 1988

[54] BODY-BUILDING APPARATUS

[76] Inventor: Gilbert E. Lederman, 15 Wood Canyon St., Bisbee, Ariz. 85603

[21] Appl. No.: 802,671

[22] Filed: Nov. 29, 1985

[51] Int. Cl.[4] ..... A63B 21/00

[52] U.S. Cl. ..... 272/134; 272/62; 272/118; 272/123; 272/DIG. 4

[58] Field of Search ..... 272/62, 93, 112, 117, 272/118, 123, 125, 126, 134, DIG. 4, 63, 703, 113, 103; 248/287, 298

[56] References Cited

U.S. PATENT DOCUMENTS

| | | | |
|---|---|---|---|
| 1,059,284 | 4/1913 | Dennis . | |
| 2,648,540 | 8/1953 | Hunter | 272/118 |
| 2,706,632 | 4/1955 | Chandler | 272/117 |
| 3,072,400 | 1/1963 | Dykinga | 272/118 |
| 3,235,255 | 2/1966 | Leflar . | |
| 3,438,627 | 4/1969 | La Lanne | 272/118 |
| 3,524,644 | 8/1970 | Kane | 272/134 |
| 3,713,653 | 1/1973 | Romans . | |
| 4,138,019 | 2/1979 | Smith | 248/298 X |
| 4,154,441 | 5/1979 | Gajda | 272/118 |
| 4,252,314 | 2/1981 | Ceppo | 272/123 X |
| 4,286,782 | 9/1981 | Fuhrhop | 272/117 |
| 4,441,706 | 4/1984 | Korzaniewski | 272/118 |
| 4,527,797 | 7/1985 | Slade, Jr. et al. | 272/118 X |
| 4,561,651 | 12/1985 | Hole | 272/123 X |
| 4,603,855 | 8/1986 | Sebelle | 272/117 |

FOREIGN PATENT DOCUMENTS

| | | | |
|---|---|---|---|
| 2065482 | 7/1981 | United Kingdom | 272/134 |

OTHER PUBLICATIONS

"Omnibod" booklet, Copyright 1982.

*Primary Examiner*—Richard J. Apley
*Assistant Examiner*—Robert D. Bahr
*Attorney, Agent, or Firm*—Gerlach & O'Brien

[57] ABSTRACT

Body-building apparatus includes an upstanding frame, a chin bar adjustably mounted on arms extending forwardly from the frame adjacent to the top of the frame, a pair of dip bars each including a rear portion, and a front portion extending angularly from the rear portion, and adjustably mounted on the frame with the front portions projecting forwardly therefrom, a forward weight-cable pulley assembly adjustably mounted on elongate support means extending forwardly from the frame adjacent to the bottom thereof, equipment-mounting brackets disposed along each of a pair of frame uprights, each bracket including a retainer and a pair of legs extending laterally from the retainer and rearwardly with respect to the frame in vertically spaced-apart relation to each other, the legs of each bracket being reciprocally movable on an upright for corresponding movement of the bracket between a forwardly extending equipment-mounting position and a rearwardly retracted collapsed position, and stop structure associated with each leg pair and its upright, for resisting movement of the corresponding bracket when in its mounting position.

9 Claims, 6 Drawing Sheets

BODY-BUILDING APPARATUS

BACKGROUND OF THE INVENTION

This invention relates to body-building apparatus, particularly, to apparatus of the multiple-station type.

Body-building apparatus or machines of various types having multiple stations or functions have been provided heretofore. In particular, I have previously devised such apparatus, which enables a body-builder to perform numerous exercises, the apparatus being identified as the "Omnibod" system. The present invention is directed particularly to such apparatus or machine, and also finds application in other types of apparatus or machines.

SUMMARY OF THE INVENTION

The invention in its preferred embodiments provides improvements in body-building apparatus of the type that includes an upstanding frame having a pair of spaced-apart front uprights, a pair of spaced-apart elongate arms extending forwardly from the frame adjacent to the top thereof, and elongate support means extending forwardly from the frame adjacent to its bottom. Improved structure includes a chin bar; means for mounting the chin bar on the arms adjustably in a selected one of a plurality of positions along the length of the arms; a pair of dip bars each including a rear portion, and a front portion extending angularly from the rear portion; means for mounting the dip bars on the frame adjustably with the front portion of each disposed in a selected one of at least two positions projecting forwardly from the frame, thereby to enable each bar to be manually gripped selectively on either of the portions; a forward weight-cable pulley assembly; means for mounting the pulley assembly on the support means adjustably in a selected one of a plurality of positions along the length of the support means; a plurality of equipment-mounting brackets disposed along each of the uprights, each of the brackets including a retainer and a pair of legs extending laterally from the retainer and rearwardly with respect to the frame in vertically spaced-apart relation to each other, the legs of each bracket being reciprocally movable on an upright for corresponding movement of the bracket between a forwardly extending equipment-mounting position and a rearwardly retracted collapsed position; and stop means associated with each of the leg pairs and its upright, for resisting the movement of the corresponding bracket when the bracket is in its mounting position. Preferably, the chin bar is provided with means for connecting it to weight-cable means in the apparatus.

Individual elements and subcombinations of the complete apparatus are independently useful, and may be employed alone or in various combinations with each other and/or other body-building apparatus.

BRIEF DESCRIPTION OF THE DRAWINGS

The drawings illustrate preferred embodiments of the invention, without limitation thereto. In the drawings, like elements represent like parts in each of the views, and.

DESCRIPTION OF THE PREFERRED EMBODIMENTS

Figure 1:
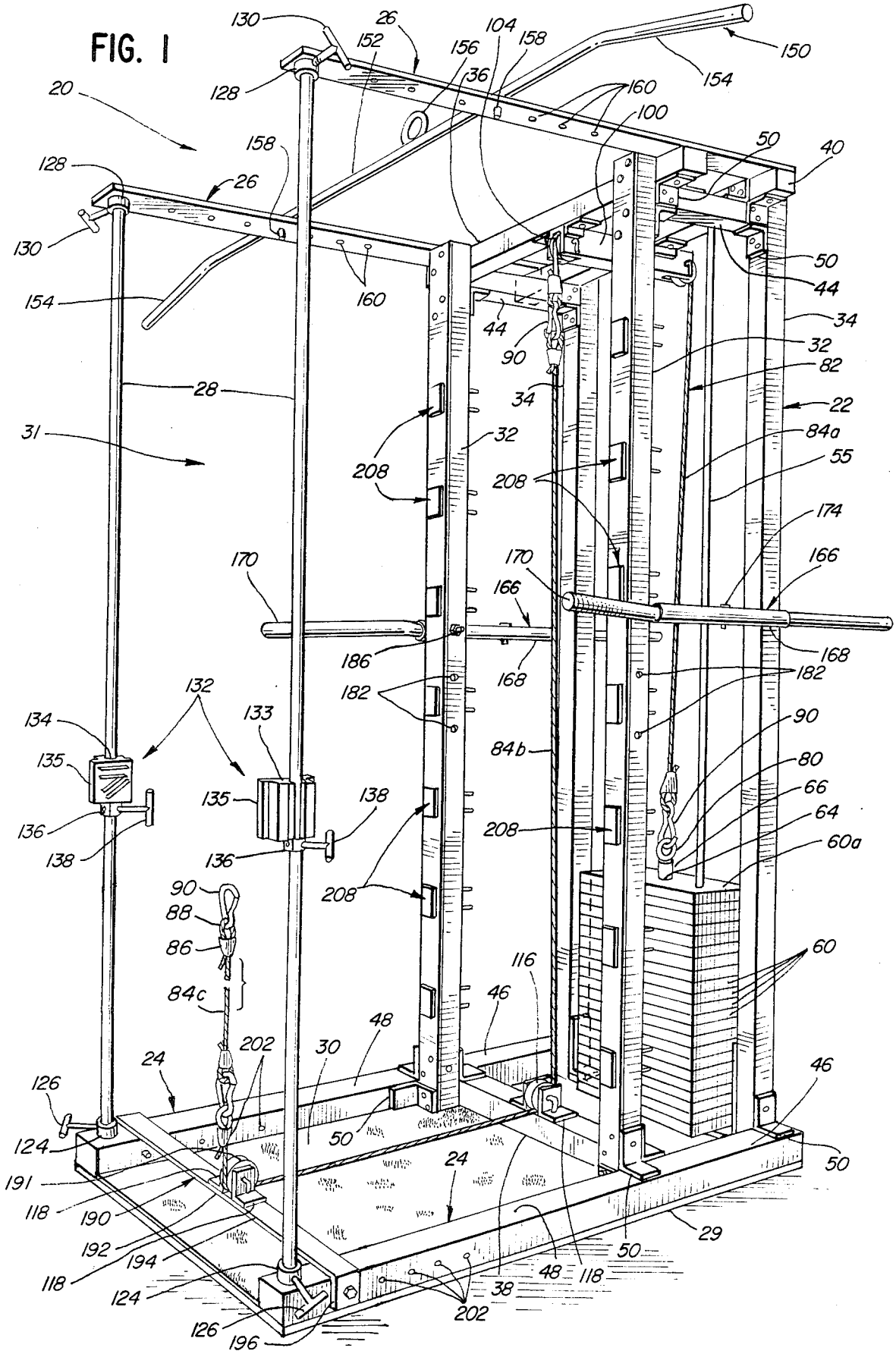
FIG. 1 is a front and side perspective view of body-building apparatus of the multiple station-type, in accordance with the invention.
Figure 2:
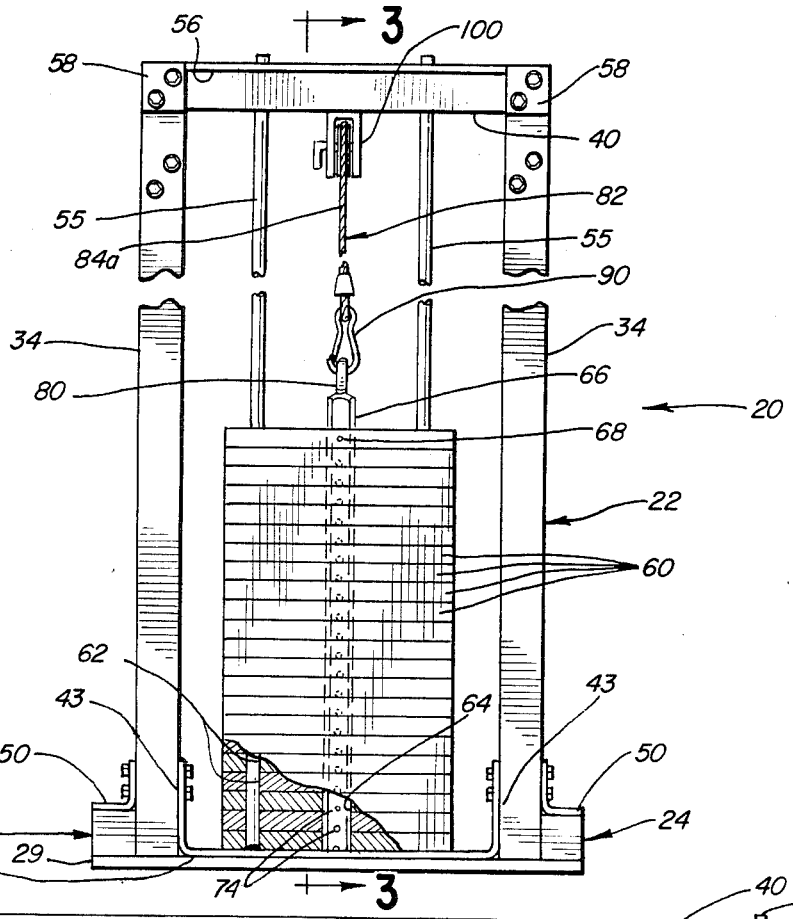
FIG. 2 is a broken rear elevational view thereof, with parts broken away and in section, and with certain parts removed.
Figure 3:
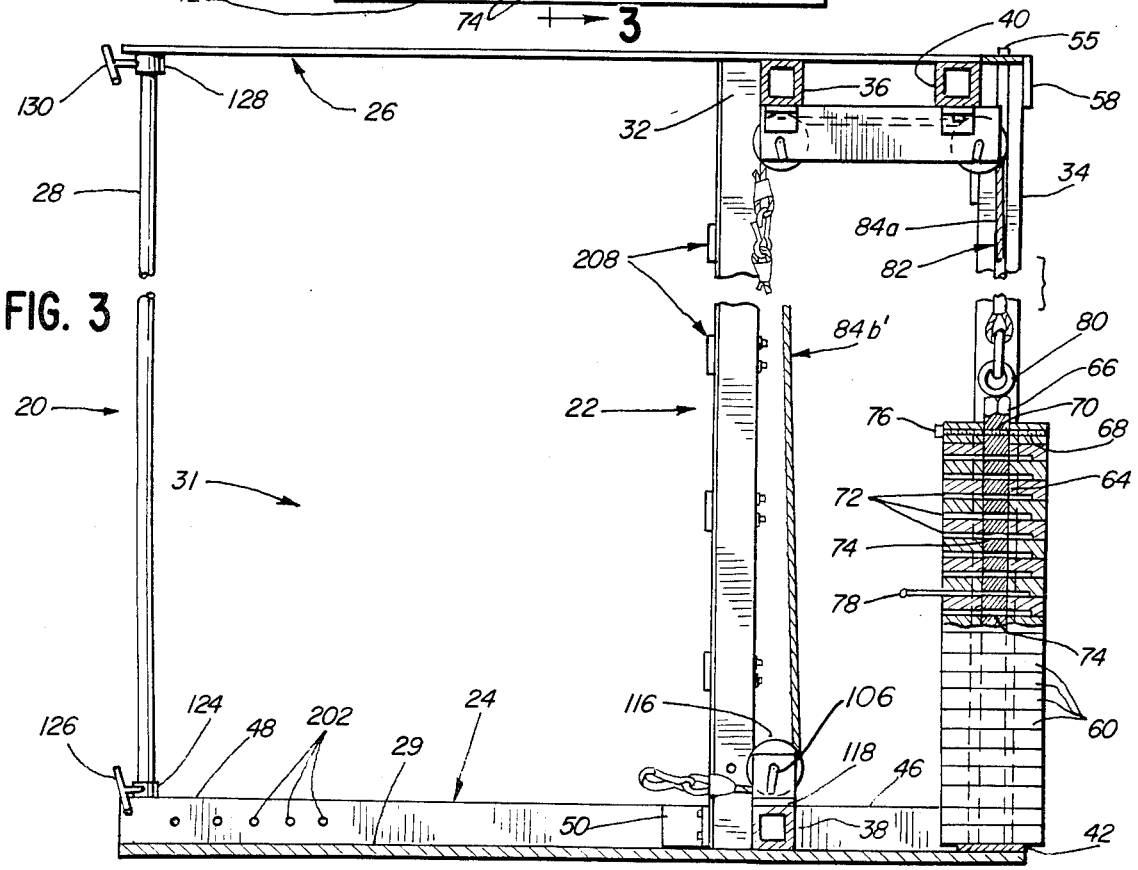
FIG. 3 is a broken longitudinal sectional view thereof, with parts broken away and in section, with certain parts removed, and showing a variation in a cable length, taken substantially on line 3—3 of FIG. 2.

Referring to FIGS. 1–3, a body-building apparatus of the multiple-station type, also referred to as a "home gym," includes a cage-like housing 20 having an open-work structure. The housing 20 includes an upstanding base frame 22, a pair of elongate supports or runners 24 at the bottom of the frame, a pair of elongate arms 26 at the top of the frame, and a pair of slide rods 28 extending upwardly from the supports to the arms. The housing 20 is portable, but it may be secured to any suitable base, such as by bolting the supports 24 thereto. In the illustrative embodiment, the bottom of the housing 20 is closed by a base panel 29, preferably of plywood, secured to the supports 24 and having a carpet section 30 fastened on top thereof.

The housing 20 provides support for equipment and apparatus temporarily or permanently mounted thereon, and also for the weight of a user's body. The base frame 22 houses resistance-providing weights, weight-cable means, and pulley means tracking the cable means. The frame 22, the supports 24, the arms 26, and the slide rods 28 generally encompass an open work area 31. The foregoing structure, in general, is like corresponding structure provided in my prior "Omnibód" apparatus.

The frame 22 is constructed of two pair of spaced apart parallel, vertical upstanding rectangularly tubular uprights, including a pair of front uprights 32 and a rearwardly spaced apart pair of back uprights 34. Parallel horizontal upper and lower crossbars 36 and 38, respectively, extend between the top and bottom ends of the front uprights 32, and are connected thereto by suitable means, preferably including bolted parts. Similarly, a horizontal upper crossbar 40 extends between and is connected to the upper ends of the back uprights 34. A horizontal weight-stacking plate 42 having upwardly-extending flanges 43 extends between the back uprights 34, and the flanges are bolted to the uprights.

Respective pairs of the front and back uprights 32, 34 are in longitudinal alignment. Horizontal longitudinally extending upper spacer bars 44 extend between the uprights in each pair, directly below the upper crossbars 36 and 40, and are secured to the uprights and to the crossbars. At the bottom of the frame 22, the supports 24 provide spacer bar sections 46, which are secured to the respective pairs of front and back uprights 32, 34. The spacer bar sections 46 are integral with front support sections 48 that extend forwardly from the frame 22.

The frame 22 thus is constructed essentially of the uprights 32, 34, the crossbars 36, 38 and 40, the stacking plate 42, the spacer bars 44, and the spacer bar sections 46. These frame members are connected together by conventional means, particularly, by bolting and welding, employing 90-degree angles or angle bars 50 at the junctions of various bars for alignment, support, and rigid fastening purposes. The angles 50 are bolted and/or welded to the several bars, as appropriate. The supports 24, the uprights 32, 34, the crossbars 36, 38, and 40, and the spacer bars 44 comprise tubular bars, preferably constructed of steel, having rectangular cross sections.

Referring particularly to FIG. 2, two spaced parallel vertically disposed weight-guide rods 55 are welded to the stacking plate 42 at their lower ends. A spacer plate 56 is mounted on top of the back uprights 34, and secured thereto by downwardly extending flanges 58 bolted to the uprights. The guide rods 55 extend through corresponding openings in the spacer plate 56, to maintain the rods in proper alignment.

Referring to FIGS. 1–3, a stack of flat rectangular weights 60 is seated on the plate 42. The weights have guide holes 62 extending through them in the vertical direction, such holes in the several weights being aligned in the stack, to receive the guide rods 55 for sliding vertical movement of the weights thereon.

As seen in FIG. 3, each of the weights 60 has a vertically extending central lifting bar opening 64. The openings 64 in the several weights 60 are in alignment in the stack of weights, to receive a lifting bar 66 vertically within the weights. The uppermost weight **60*a* also has a threaded bore 68 extending into the weight from front to rear and intersecting a transverse hole 70 in the lifting bar 66 adjacent to its upper end. The remaining weights 60 have grooves 72 in the bottoms of the weights that extend centrally from their front sides and register with respective additional equidistantly spaced transverse holes 74 in the lifting bar 66. The top weight 60*a* is secured to the lifting bar by a bolt 76 inserted in its bore 68 in threaded engagement with the weight therein, and extending through the top hole 70 in the lifting bar 66**.

A key or selector pin 78 is inserted in the groove 72 in a selected one of the remaining weights 60, and through the registering hole 74 in the lifting bar 66, to secure that weight, and the weights 60 above that weight, to the lifting bar 66, for supporting such weights thereon. The weights secured to the bar 66 provide a corresponding amount of weight resistance to the raising or lifting of the bar 66 from a rest position with the weights stacked. When the lifting bar is raised, the weights **60*a* and 60 above the key 78 are raised with the lifting bar, and the weights 60 below the key 78 remain stacked on the plate 42**.

Figure 5:
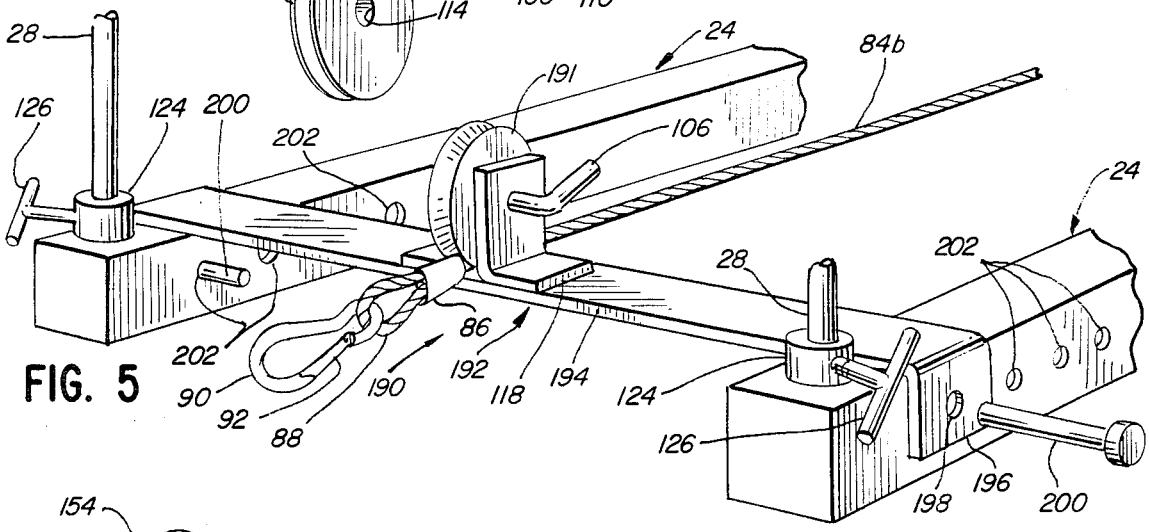
FIG. 5 is an enlarged fragmentary perspective view of the apparatus at the bottom thereof, showing a forward pulley assembly.

A connecting ring 80 is secured to the top of the lifting bar 66, for connecting weight-cable means 82 to the bar. The cable means 82 in one illustrative embodiment, illustrated in FIG. 1, comprises a cable train or series of first, second and third cable lengths or links **84*a*, 84*b*, and 84*c*, respectively, detachably connected to each other at adjoining ends. Referring also to FIG. 5, both ends of each cable length 84*a–c* are looped and secured by a clamp band fastener 86, to provide a connecting loop 88 at each end of the cable length. A conventional snap hook fastener 90, having a spring-pressed gate 92, is carried by the connecting loop 88 on a leading end of each length 84*a*, *b*, and *c*, for connecting such length to the loop 88 at the adjoining end of the next successive cable length, or to another object. A fastener 90 on the loop 88 at a trailing end of the first cable length 84*a* in the series is fastened to the connecting ring 80 on the lifting bar 66. Alternatively, longer or shorter cable lengths may replace one or more of the lengths 84*a–c*, for various uses. Thus, for example, a shorter second length 84*b'* is shown in FIG. 3**.

Figure 4:
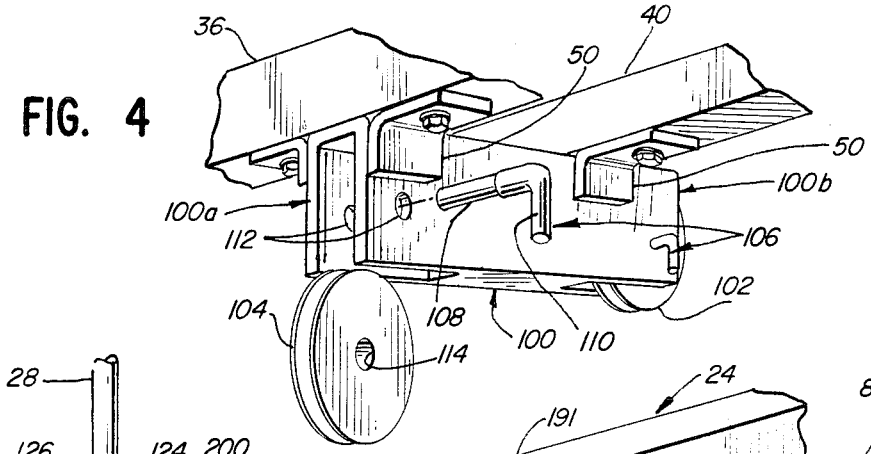
FIG. 4 is an enlarged fragmentary and partly exploded perspective view thereof, showing an upper pulley mount.

Referring especially to FIG. 4, a pulley housing 100 is mounted at the top of the frame 22 and extends longitudinally thereof. The housing 100 is a channel-like member having U-shaped front and rear ends **100*a* and 100*b* that house respective front and back upper weight-cable pulleys 104 and 102. The pulley housing 100 is secured to the upper front and back crossbars 36 and 40 by angles 50**, welded to the housing and bolted to the crossbars.

Pulley-mounting journal pins 106 served to detachably or removably mount the pulleys 102 and 104 in the housing 100. Each mounting pin 106 includes a cylindrical bearing portion 108 and an integral handle 110 joined to the bearing portion by a right angle bend. The bearing portion 108 is received in aligned holes 112 in the walls of the housing 100, and extends through an axial cylindrical journal opening 114 in each pulley, for rotation of the pulley around the bearing portion. A pulley may be removed by pulling its mounting pin 106 out of the housing 100 and out of the pulley opening 114. The pulleys are removed for extending a cable length through the housing 100 over the pulleys, and for removing the cable length therefrom. The first cable length 84*a* is trained on the upper pulleys 102 and 104.

Referring to FIGS. 1 and 3, a lower weight-cable pulley ll6 is mounted on the lower front crossbar 38 by means of pulley-mounting brackets 118 welded to the crossbar, and a pulley-mounting journal pin 106. The pulley 116 is mounted between the brackets 118 and detachably secured by the pin 106, in like manner to the mounting of the upper pulleys 102 and 104, as described hereinabove. The second cable length 84*b* or 84*b'* is trained on the lower pulley 116, passing underneath the same. The trailing end of the second cable length 84*b* or 84*b'* is connected to the leading end of the first cable length 84*a*, by the loop and fastener connection 88, 90 previously described (see FIG. 5). The connection is made between the front upper pulley 104 and the lower pulley 116. The leading end of the second cable length 84*b* or 84*b'* is disposed on the opposite side of the lower pulley 116, extending forwardly from the frame 22. The weight-cable pulley means so far described, their mounting means, and their connections to the weights 60 and to each other generally follow the design of my prior "Omnibod" structure.

Figure 12:
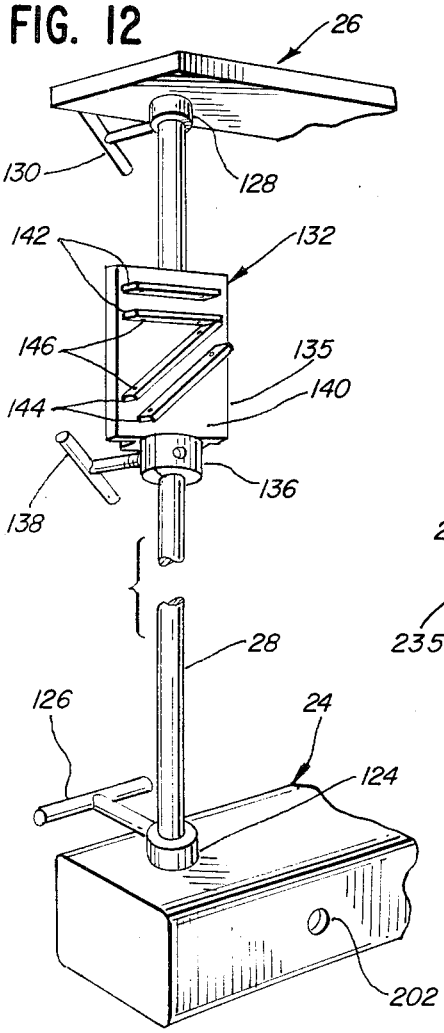
FIG. 12 is an enlarged broken fragmentary perspective view of the apparatus, illustrating a slide rod and a slide mounted thereon at the front of the apparatus.

Referring to FIGS. 1, 3 and 12, a lower slide rod-mounting ring 124 is fixedly mounted on each support 24 adjacent to its front end, as by welding, and a T-screw 126 extends through the ring in threaded engagement therewith. Each ring receives the bottom end of a slide rod 28, to support the slide rod on a support 24. The slide rod 28 is secured in the ring 124 by tightening the T-screw thereagainst, in the manner of a setscrew. Similarly, an upper slide rod-mounting ring 128 is fixedly secured, as by welding, to the lower surface of each arm 26, adjacent to its front end. A T-screw 130 extends through each upper ring 128 in threaded engagement therewith, and when tightened bears against the upper end of a slide rod 28 received in the ring, thereby supporting the arm 26 on the slide rod.

An equipment-carrying slide 132 is slidably mounted on each of the slide rods 28. A slide rod 28 extends through a partly cylindrical opening 134 extending vertically in the body 135 of each slide 132 (see FIGS. 1 and 17). A conventional linear bearing 133 is mounted in each body opening 134, for easy sliding movement of the slide. Each slide 132 is supported at a desired height on its slide rod 28 by means of a split ring clamp 136 secured under the slide. The clamp 136 has a T-screw 138 in threaded engagement therewith, for tightening and loosening the clamp around the slide rod 28, for slide support and adjustment purposes.

Referring particularly to FIG. 12, the normally (in use) inner surface 140 of each slide body 135 is provided with a pair of spaced parallel horizontal equipment-mounting brackets 142, and a pair of spaced parallel oblique equipment-mounting brackets 144 therebelow, the brackets being rigidly mounted on the surface 140, as by welding. Pin holes 146 are provided in the brackets 142 and 144, adjacent to their opposite ends, for receiving equipment fastening pins 148 (FIG. 13) therethrough.

The slide rod and slide construction and operation, and their assembly with the supports 24 and the arms 26 are similar to structure provided in my prior body-building apparatus, identified hereinabove. It will be noted that the apparatus as so far described, and likewise as completed with additional parts and structure to be described, may be disassembled completely, for transportation from one place to another and assembly for use in any suitable location.

The present invention provides new apparatus that significantly improves the performance of numerous functions which were performed with the prior apparatus, and also increases the functionality of the prior apparatus. The ease and efficiency of use, and the security in use are increased. The apparatus is more versatile, being adaptable to the performance of a greater number of beneficial exercises and routines.

Figure 6:
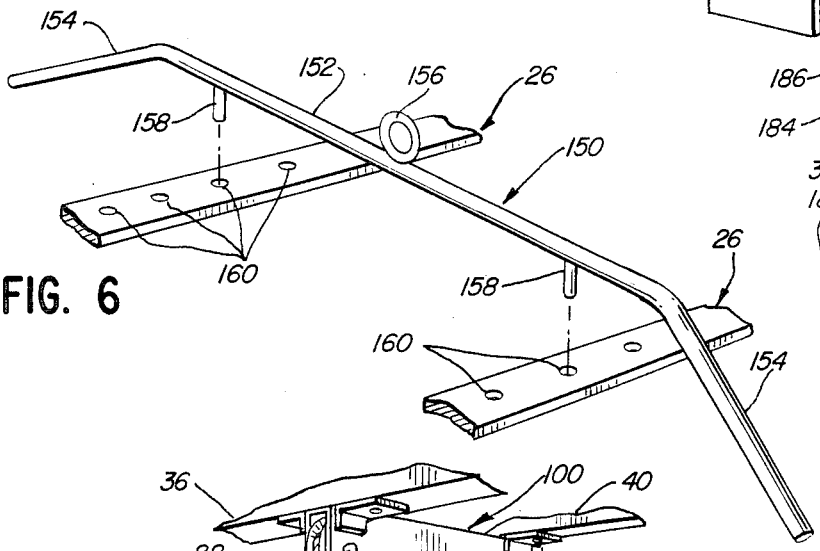
FIG. 6 is a fragmentary exploded perspective view of the apparatus at the top thereof, showing a chin bar.
Figure 7:
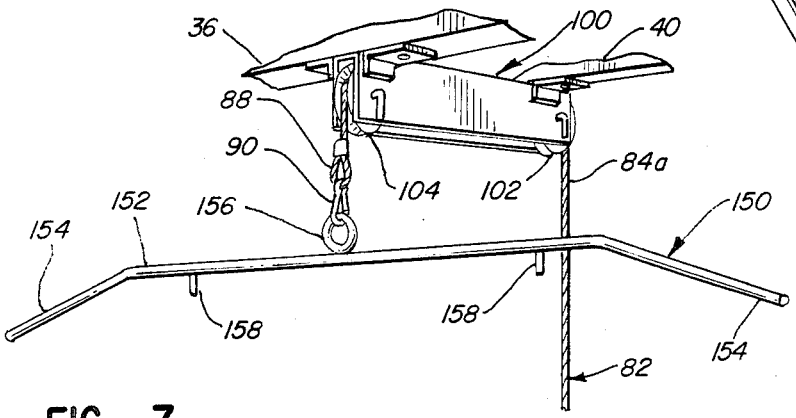
FIG. 7 is a fragmentary perspective view of the apparatus, showing the pulley mount of FIG. 4 on a smaller scale, having a weight-cable trained on pulleys therein and connected to the chin bar.

Referring to FIGS. 1, 6, and 7, a chin bar or chinning bar 150 includes a rectilinear central chinning portion 152 and oblique lateral portions 154 extending integrally from opposite ends of the chinning portion. A connecting ring 156 is fixedly secured on top of the chin bar 150, centrally of the chinning portion 152, such as by welding. Two spaced parallel locator pins 158 are fixedly secured to the bottom of the chin bar 150, in spaced adjacent relation to the opposite ends of the chinning portion 152, such as by welding.

In the preferred illustrative embodiment, each of the arms is provided with a plurality of spaced apart circular pin openings 160 along the length of the arm and forwardly of the frame 22. The openings 160 are sized to receive a locator pin 158 in each, thereby to provide means for mounting the chin bar 150 on the arms 26 adjustably in a selected one of a plurality of positions along the length of the arms. Such adjustability provides for use by individuals of different sizes, and also enables the user to use the chin bar 150 in different ways and in conjunction with the use of additional equipment. The connector ring 156 provides means for connecting the chin bar to cable means trained on pulley means in the apparatus.

Figure 8:
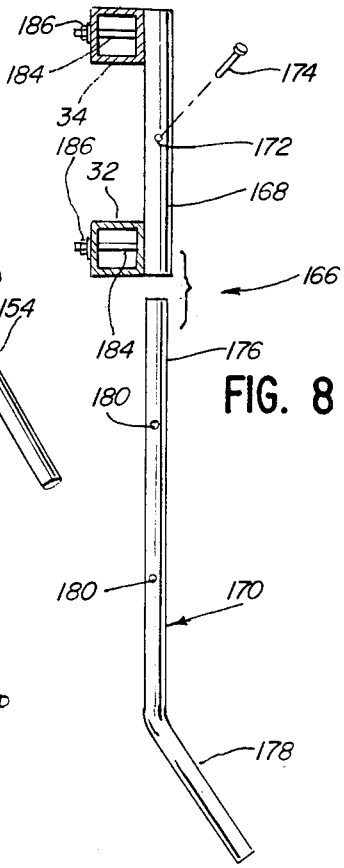
FIG. 8 is an enlarged exploded plan view of a dip bar assembly in the apparatus, which is mounted on frame uprights, shown in section.

Referring particularly to FIGS. 1 and 8, a dip bar assembly 166 is mounted on the frame 22. The assembly includes a cylindrical tubular holder or support 168, and a dip bar 170 telescopically received in the holder for sliding movement therein. The holder 168 is provided with diametrically opposed pin holes 172 in the wall thereof, and a headed latch pin 174 is received in the holes, to extend through the holder 168. The dip bar 170, formed of solid cylindrical bar stock, includes a rectilinear rear portion 176, and an integral rectilinear front portion 178, that extends angularly, preferably at about 30°, from the rear portion. The rear portion is provided with two pin holes 180 extending through the rear portion 176 in spaced apart relation along the length thereof. The rear portion 176 is telescopically received in the holder 168, for registry of the dip bar pin holes 180 successively with the pin holes 172 in the holder. When in such register, the latch pin 174 may be inserted through the registering holes 172 and 180, to secure the dip bar 170 in a selected fixed longitudinal position relative to the holder 168.

As illustrated in FIG. 1, each of the front and back uprights 32 and 34 is provided with a plurality of bolt holes 182 in spaced apart relation along the length of the upright, in pairs of registering or opposed holes on opposite sides of the upright. In the illustrative embodiment, holes are provided at three locations along each upright, at about 6-inch intervals. Referring also to FIG. 8, two holder bolts 184 are fixedly secured to each holder 168 and extend laterally therefrom. Each bolt 184 is inserted through a pair of bolt holes 182 at a selected elevation on one upright of a pair of front and back uprights 32, 34. The bolts are secured by nuts 186 in threaded engagement therewith, thereby to mount the holder 168 fixedly on the frame 22.

The dip bars 170 when positioned on and secured to the holders 168 are mounted with the dip bar front portions 178 each projecting forwardly from the frame 22. The adjustable mounting provided by the pin holes 172 and 180, and the latch pin 174, enables the front portions 178 to be disposed in a selected one of at least two positions, whereby the dip bar may be manually gripped selectively on either the front portion 178 or the rear portion 176, depending upon the extent of projection of the dip bar forwardly from the frame 22. It will be noted that in the illustrative mounting, the front portions extend obliquely forwardly and outwardly, increasing the span therebetween from the span between the rear portions 176. Alternatively, by rotating the dip bars 170 through 180 degrees on the holder 168, the front portions 178 may be disposed to extend forwardly and inwardly on the frame 22. In a further alternative, the dip bars 170 may be extended forwardly for other distances, omitting use of the latch pin 174.

Referring to FIGS. 1 and 5, a forward pulley assembly 190 is mounted on the supports 24. The assembly includes a mounting bar 192, a pair of pulley mounting brackets 118, a forward pulley 191, and a pulley-mounting journal pin 106.

The mounting bar 192 includes an elongate rectangular body portion 194 and an ear 196 at each end of the body portion, integral therewith, and bent at an angle of 90° thereto. Each ear is provided with a circular opening 198 sized to receive the shank of a headed adjustment pin 200 therethrough.

Each support 24 is provided with pairs of registering openings 202 in opposite side walls thereof and disposed in spaced apart relation along the length of the support, in transverse alignment with respective pairs of openings 202 in the other support. The openings 202 commence in spaced adjacent relation to the front ends of the support 24, and extend in rows approximately to the midpoint of the front support section 48 in the illustrative embodiment. The forward pulley assembly 190 may be removably mounted on the supports 24, with the body portion 194 of the mounting bar 192 seated on top of the supports and the ears depending from the body portion and disposed with the ear openings 198 in register with selected support openings 202. The adjustment pins 200 may be inserted through the registering openings 198 and 202, to secure or connect the pulley assembly 190 to the supports 24. In this manner, the forward pulley assembly 190 may be mounted on the supports 24 adjustably in a selected one of a plurality of positions along the length of the supports and spaced forwardly from the lower pulley 116 mounted on the frame 22.

Figure 14:
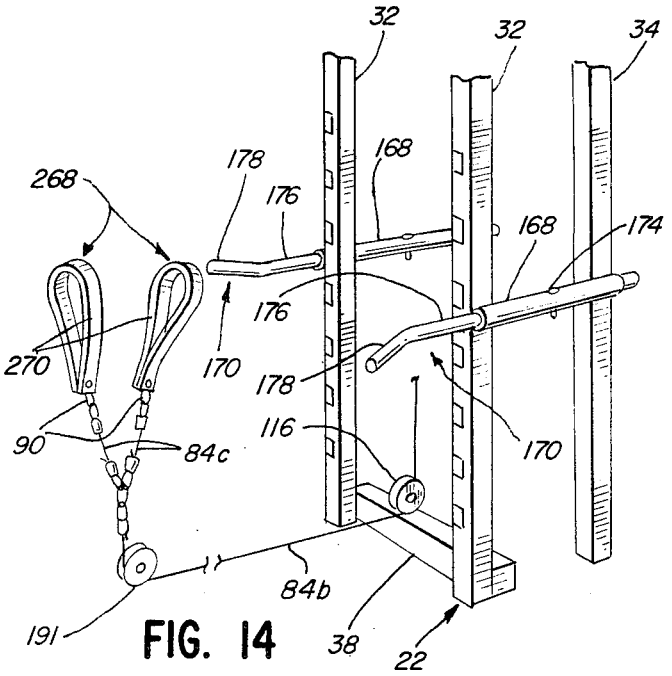
FIG. 14 is a schematic front and side perspective view of the apparatus, showing the dip bar assemblies, and the forward pulley assembly with a weight-cable thereon connected to a pair of leg straps.
Figure 13:
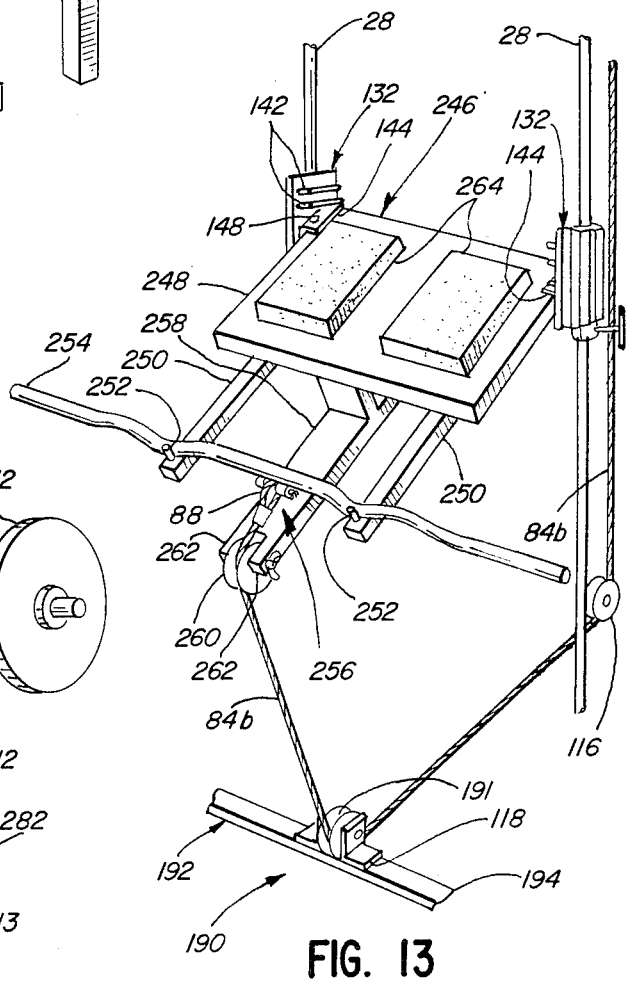
FIG. 13 is a fragmentary front and side perspective view of the apparatus, illustrating the forward pulley assembly, the slide rods and the slides, and their use with equipment mounted on the slides.
Figure 17:
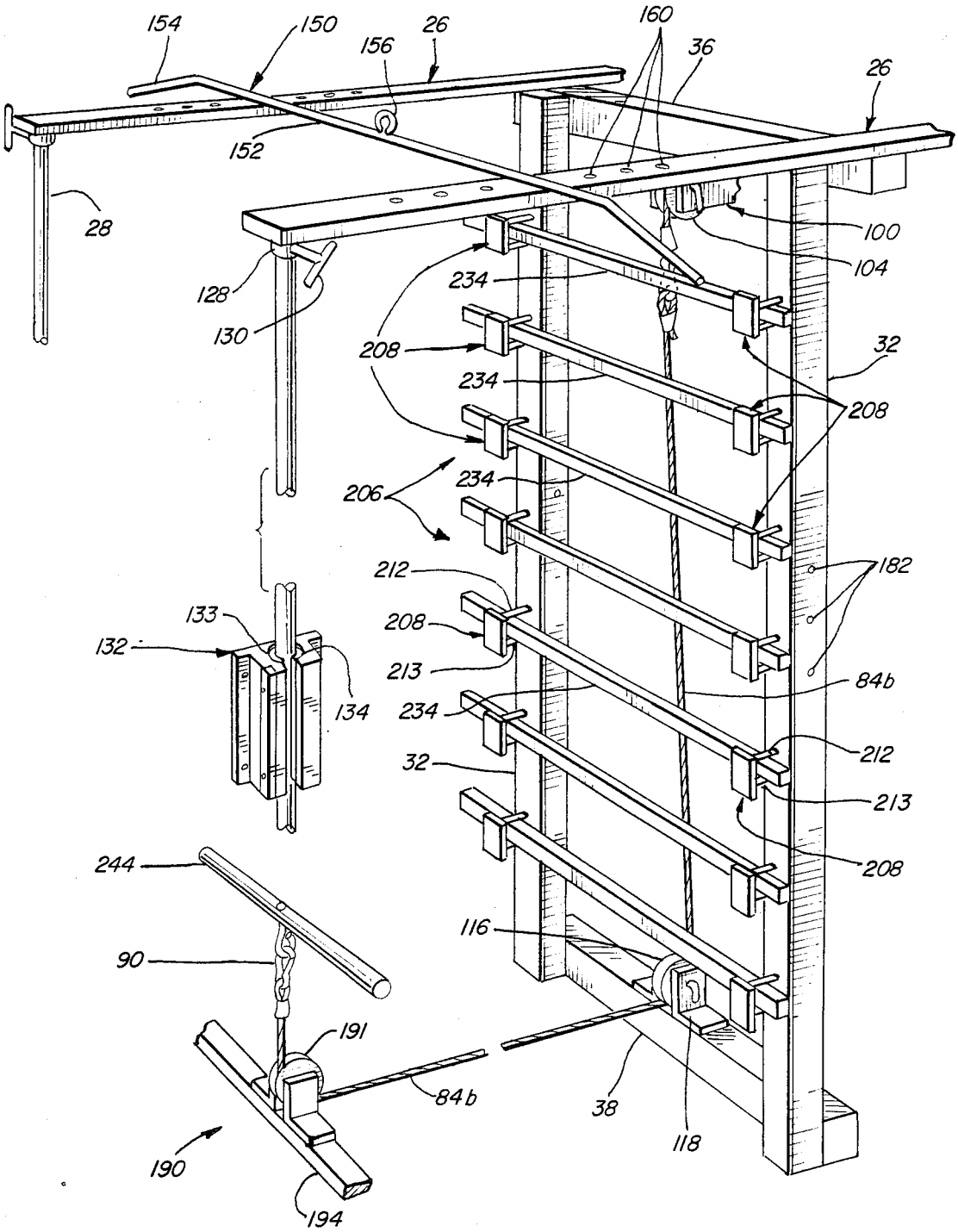
FIG. 17 is a schematic fragmentary front and side perspective view of the apparatus, showing the frame uprights having bars supported on the brackets thereon, the chin bar, and the forward pulley assembly having a weight-cable trained thereon and connected to a pull bar.

Cable means trained on the front upper pulley 104 and the lower pulley 116 may be received on the forward pulley 191, for connection of the second cable length **84*b* or the third cable length 84*c* to equipment employed in forwardly spaced relation to the frame 22. For example, the forward pulley assembly 190 may be mounted adjacent to the front ends of the supports 24, for connection of the second cable length 84*b* to equipment carried by the slides 132, as shown in FIG. 13 and described hereinafter. Either the second cable length 84*b* or the third cable length 84*c* may be connected to unsupported equipment, as shown in FIGS. 14 and 17**.

Figure 9:
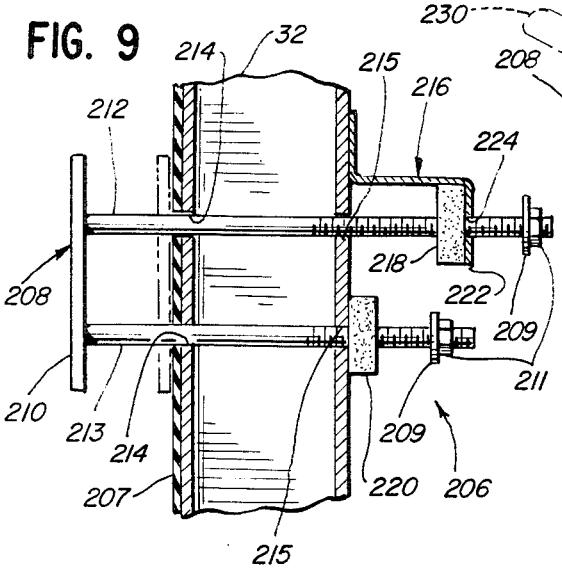
FIG. 9 is a further enlarged fragmentary vertical sectional and elevational view of the apparatus, showing an equipment-mounting bracket assembly mounted on an upright for reciprocal movement of the bracket thereof on the upright, between positions respectively shown in full and phantom lines.
Figure 10:
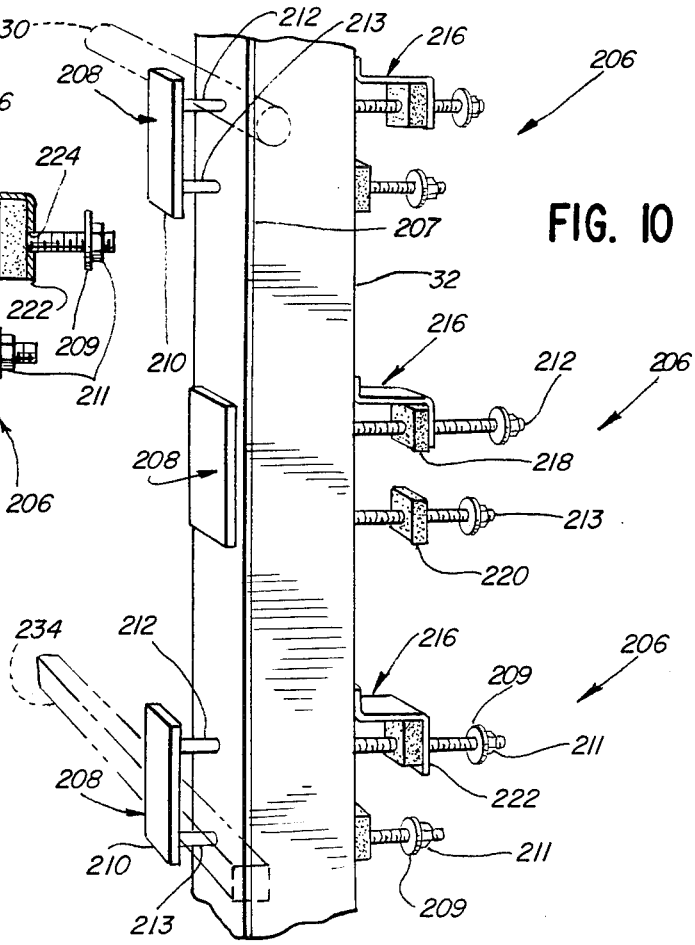
FIG. 10 is an enlarged fragmentary front and side perspective view of an upright and several such bracket assemblies mounted thereon, illustrating in phantom lines objects that may be supported on the brackets.

Referring to FIGS. 1, 9 and 10, a plurality of equipment-supporting bracket assemblies 206 is mounted on each of the front uprights 32 in vertically spaced-apart relation, the assemblies numbering seven in the illustrative embodiment. FIGS. 9 and 10 also illustrate the preferred provision of a facing strip 207 of an elastic or resilient material, such as neoprene, forming the front surface of each front upright 32. Each bracket assembly 206 includes a bracket 208 and stop means associated with the bracket and the upright 32 on which it is mounted. Each bracket 208 includes a flat plate-like retainer 210 and two cylindrical legs or rods 212 and 213 fixedly secured to one side of the retainer, such as by welding, and extending laterally from the retainer in a spaced parallel relation. The outer ends of the legs 212, 213 are threaded, and a washer 209 is received on each end and retained by a nut 211 threaded on the end.

Two pair of registering leg-receiving holes 214 and 215 are provided in the front and back walls of each upright 32, for each bracket 208. The retainer 210 of each bracket is disposed on the front side of its upright 32, and the legs 212, 213 extend rearwardly from the retainer, through respective pairs of holes 214, 215 in the upright, in vertically aligned, spaced-apart relation. The washers 209 and the nuts 211 are disposed to the rear of the upright. The legs 212, 213 of each bracket 208 are reciprocally movable on an upright 32 for corresponding movement of the bracket between a forwardly extending, equipment-supporting position, shown in full lines in FIG. 9, and a rearwardly retracted, collapsed position, shown in phantom lines in FIG. 9.

The stop means associated with each bracket 208 includes an abutment 216 fixedly secured to the back side of an upright 32, as by welding, a square stop ring 218 on one of the legs 212, and a square stop ring 220 on the remaining leg 213, in the embodiment of FIGS. 9 and 10. The abutment 216 is in the form of a rectangular strip bent at right angles in two spaced-apart locations, to provide a depending rear stop flange 222, having a circular hole 224 or other suitable opening serving to receive the upper leg 212 of a bracket extending therethrough.

Each of the stop rings 218 and 220 is disposed rearwardly of an upright 32, and receives one of the legs 212, 213 therethrough in relatively tight frictional engagement around the ring. The stop ring 218 on the upper leg 212 is captured between the rear surface of the upright 32 and the front surface of the stop flange 222, while the washer 209 and the nut 211 on such leg are disposed rearwardly of the flange 222.

The full line illustrations of the parts in FIG. 9 illustrate the manner in which the stop means provide resistance to movement of the bracket 208 when in its equipment-supporting position, with the retainer 210 projecting forwardly from the upright 32 in spaced relation thereto. Thus, a force tending to pull the bracket 208 forwardly, to the left in FIG. 9, is resisted by engagement of the lower stop ring 220 with the backside of the upright 32. A force tending to move the bracket rearwardly of the frame 22 is resisted by engagement of the upper stop ring 218 with the stop flange 222. The stop rings 218 and 220 provide relatively fine adjustment of the spacing between the retainers 210 and the uprights 32, to correspond to the size or dimensions of the equipment to be supported on the legs 212, 213 and held in place thereon. The washers 209 and the nuts 211 prevent the legs 212, 213 from being pulled out of the uprights 32 unintentionally.

When it is desired to collapse the bracket 208, into the position of one part shown in phantom lines, the bracket may be pushed rearwardly, to overcome the friction that resists movement, whereby the upper leg 212 moves rearwardly and slidably relative to the stop ring 218. When it is desired once more to place the bracket 208 in its forwardly disposed supporting position, shown in full lines, the bracket may be pulled forwardly, until the stop ring 220 on the lower leg 213 abuts on the rear surface of the upright 32, to stop forward movement. The upper stop ring 218 in the illustrative embodiment may likewise abut on the upright, and remain there while the upper leg 212 is pulled therethrough, depending upon the spacing of the stop flange 222 from the upright. When the lower stop ring 220 is in engagement with the upright 32, the upper stop ring 218 may be moved rearwardly, by finger pressure, while holding the retainer 210, until the upper ring abuts on the stop flange 222 in the manner illustrated in FIG. 9. The bracket 208 then is prevented from moving forwardly or backwardly, unless forcibly moved, generally by force applied intentionally for such purpose. The illustrative structure is designed to protect against accidental dislodgement of a bracket or brackets 208 while a user of the apparatus is working with equipment supported on the brackets, as described hereinafter.

Figure 16:
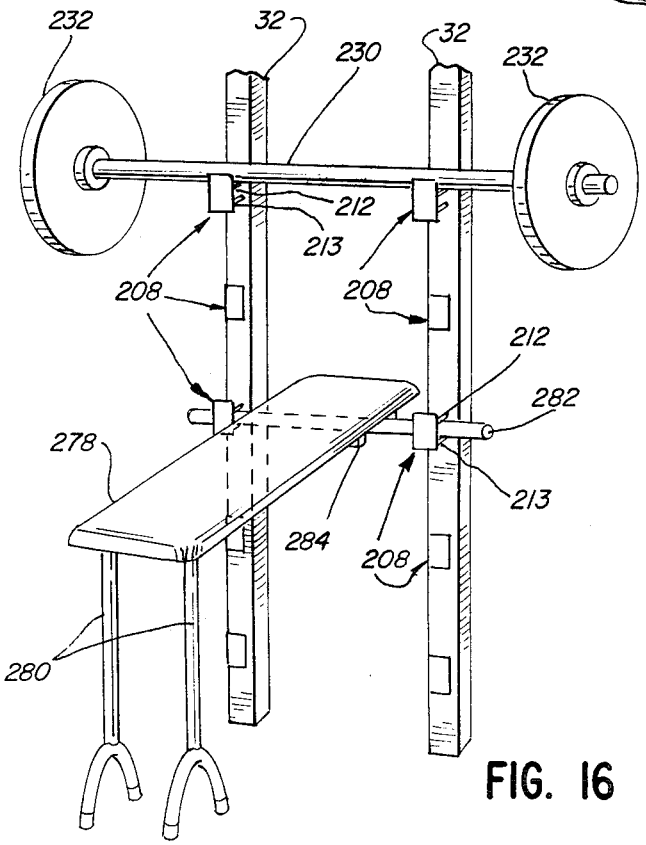
FIG. 16 is a schematic fragmentary front and side perspective view of the frame uprights, illustrating support of a bench and a barbell thereon by means of the bracket assemblies.

FIG. 10 shows three of the bracket assemblies 206 on an upright 32. The uppermost bracket 208 is illustrated in an equipment-supporting disposition, wherein the retainer 210 is spaced forwardly from the upright 32, and portions of the legs 212, 213 project forwardly from the upright. A portion of a cylindrical steel barbell 230 or the like is shown resting on the upper leg 212, between the retainer 210 and the front face of the upright 32. The mounting of the barbell 230 with weights 232 thereon is illustrated in FIG. 16.

The next successive bracket 208 illustrated in FIG. 10 is shown in its rearwardly retracted collapsed position. The lowermost bracket 208 is shown in its forwardly extended equipment-supporting position, with a rectangular bar 234, illustrated in phantom lines, shown as extending between the upper and lower legs 212, 213 of the bracket. FIG. 17 illustrates such a bar 234 supported between the legs 212, 213 of each bracket 208 of each horizontally aligned pair of brackets 208 on the uprights 32, the bars thus constituting the rungs of a ladder structure completed by the uprights.

Figure 11:
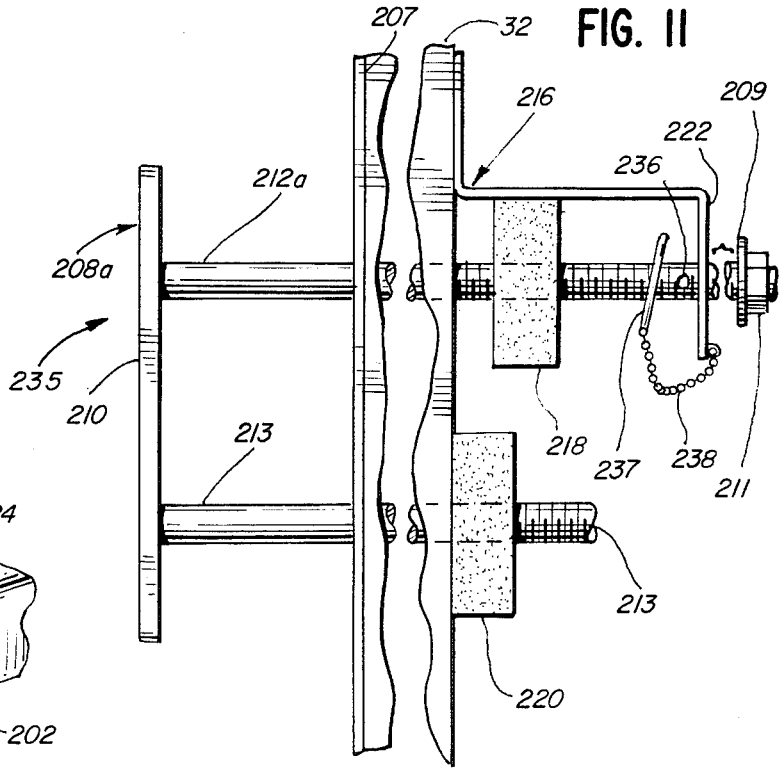
FIG. 11 is a fragmentary elevational view of an alternative embodiment of the bracket assembly of the invention, mounted on an upright.

FIG. 11 illustrates an alternative bracket assembly 235 additionally provided with fixed stop means, that prevent collapse of an alternative bracket **208*a* if struck with heavy force, as by a heavily loaded barbell. The assembly 235 includes the alternative bracket 208*a*, the stop means of the preceding embodiment, and the fixed stop means. The alternative bracket 208*a* is like the preceding bracket 208, and, additionally, is provided with a stop pin-receiving hole 236 extending transversely through its upper leg 212*a***, adjacent to the outer end of the leg. Additional like holes may be provided along the leg, if so desired.

A stop pin 237 is provided, and it may be inserted in the pin-receiving hole 236, forwardly of the stop flange 222, to provide a fixed or immovable stop. One end of the pin 237 is connected by a chain 238 to the back side of the stop flange 222, for retention of the pin in a conveniently accessible location. With the pin 237 inserted in the hole 236, the pin prevents rearward movement of the upper leg **212*a*, and thus of the bracket 208*a*, when the pin abuts on the stop flange 222. With the pin 237 removed from the hole 236, the upper stop ring 218 functions in the stop means. The alternative bracket assembly 235 may be provided at some or all of the locations on the uprights 32 that are illustrated for the preceding assembly embodiment 206**.

The new body building apparatus enables a user to perform numerous exercises and routines, with and without weight resistance. The resistance provided by the weights 60 acts through the lifting bar 66, to which the weights are connected, and through one or more of the cable lengths **84*a–c*. The amount of resistance provided is determined by the setting or location of the key 78. Thus, when the key 78 is inserted in the groove 72 of one of the weights, that weight and all weights above it, together with the bar 66, comprise the resistance provided to movement of the cable means 82 or any part thereof. The resistance is deceased by inserting the key 78 in the groove 72 of a higher weight 60 in the stack, and increased by inserting the key in the groove 72 of a lower weight 60. The weights 60 below the key 78 remain seated on the stacking plate 42** when the weights thereabove are raised.

The provision of the several cable lengths **84*a*, 84*b*, 84*b*′, 84*c*, and others enables the user to select the most workable or effective location at which to connect other apparatus. For example, referring to FIG. 1, by disconnecting lengths 84*b* and 84*c* from the first length 84*a*, other apparatus may be connected to the first length adjacent to the front upper pulley 104, for exercises involving a downward pull or a downward and outward pull against the weight resistance. As another example, referring to FIG. 3, by using a shorter second length 84*b*′, and no third length, apparatus may be attached to the second length in the vicinity of the lower pulley 116, for exercises involving a generally horizontal pull, or an outward and upward oblique pull, against the weight resistance. With the three lengths 84*a–c* joined together, as in FIG. 1, apparatus may be attached to the end of the third length 84*c***, for a generally upward pull, an upward and outward pull, or an upward and inward pull against the weight resistance.

The provision of the forward pulley assembly 190 enables the cable means 82 or the like to be employed with greater facility in the work area 31, where the cable means may be connected to the body of the user or to various apparatus operating in and around that area. The disposition of the pulley assembly 190 is readily adjusted longitudinally, by removing and replacing the adjustment pins 200 in the several pin openings 198 and 202, in the mounting bar ears 196 and the supports 24, respectively, as the mounting bar 192 is shifted forwardly or rearwardly.

The bracket assemblies 206 serve for mounting various bars for support on the frame 22, and also furnish a safe and reliable ladder, with the insertion of the bars 234 as rungs. The stop means in the bracket assemblies provide a safety feature in use, as described hereinafter.

The drawings illustrate several ways in which the improved apparatus may be used, and the cooperation of the elements and sub-assemblies of the apparatus with each other. Thus, referring to FIGS. 1 and 6, the chin bar 150 is adjustably mounted on the arms 26 in the present apparatus, to provide substantial improvement over the prior mounting directly on uprights. Not only is the user enabled to chin himself in the usual manner, by grasping the chinning portion 152 with the hands and raising and lowering himself while in an upright position, but the bar now is in a very convenient position for hanging therefrom by the legs, wearing what are known as "gravity boots", which hook onto the bar.

The user hangs upside downin the open work area, and in exercising, may make use of various other elements of the apparatus. In each use, the adjustable mounting enables the user to place the chin bar 150 in the most convenient location relative to the remaining apparatus.

Referring to FIG. 17, use of the front uprights 32, the bracket assemblies 206, and the bars 234 to provide a ladder structure enables individuals of various sizes to easily and safely reach and use the chin bar 150. Use of the ladder structure is especially advantageous when gravity boots are being worn, and it is necessary to hook them on the chin bar 150 and lower the body therefrom, head down. Likewise, dismounting from the chin bar 150 is easier and safer.

A pull bar 244 may be connected to the second cable length 84*b*, extending upwardly from the forward pulley assembly 190. A user wearing gravity boots and hanging from the chin bar 150 thereby may grasp the pull bar 244 with his hands, and exercise his arm muscles and/or other muscles of the body, against the resistance provided by the weights 60. Similarly, a pair of pull bars 244 or the like, not illustrated, may be connected to the third cable length 84*c*, for increasing the range of mobility of the user's arms while exercising. In another alternative, the pull bar 244 may be replaced by a longer bar, not illustrated, which can be seated on top of a pair of mounting brackets 208, while the user rests between sets of the same exercise.

The chin bar 150 is used to perform other exercises, by removing it from the arms 26 and connecting it to a cable length by its ring 156. For example, the bar can be connected to the end of the first cable length 84*a*, as illustrated in FIG. 7, while the user stands on the floor in the work area 31, for performing exercises referred to as "lat pulls". The chin bar 150 can be moved against the resistance of the weights 60 as it is pulled in various directions from the front upper pulley 140. The first cable length 84*a* travels smoothly over the upper pulleys 102 and 104, on which it is trained, while the weights 60 are moved up and down on the guide rods 55, as the chin bar is moved away from end towards the front pulley 104. The amount of resistance can be increased or decreased at any time, by inserting the key 78 into a groove 72 in an appropriate weight and into engagement with the lifting bar 66 in the registering hole 74 in the bar.

The adjustable mounting means for the forward pulley assembly 190 enables it to be mounted adjacent to the front ends of the supports 24, for connection of the cable length 84*b* received on the assembly to equipment carried by the slides 132, such as illustrated in FIG. 13. This view illustrates a "preacher" curl board 246 mounted on the slides 132. The curl board 246 includes a flat rectangular body 248 that is received between the oblique slide brackets 144 and secured thereto by fastening pins 148. The curl board 246 includes a pair of spaced parallel elongate bar supports 250, that extend forwardly and downwardly from the body 248. A bar-supporting pin 252 extends upwardly from each of the supports 250, for retaining a curl bar 254 that is seated on the supports 250. The loop 88 at the end of the second length 84*b* is connected to the curl bar 54 by a spring-biased sliding pin-type fastener 256, the pin of which extends through the loop 88. A pulley holder 258 is mounted on the underside of the body 248, and a pulley 260 is mounted between the bifurcations 262 of a bifurcated outer end thereof. The second cable length 84*b*, extending upwardly and outwardly from the forward pulley 191, is trained over the curl board pulley 260.

The curl board 256 is employed in the usual manner, while the user stands in the work area 31, behind the curl board. The user's arms are extended from his body and over the body 248 of the curl board, and they rest on pads 264 thereon. The user's hands grasp the curl bar 254, inside of the bar supports 250, and the hands and forearms are moved upwardly in an arcuate path, while the elbows rest on the pads 264, in the usual manner for performing curls. The weights 60 provide resistance to the exercise, and they take the place of free weights which might otherwise be mounted on the end portions of the curl bar 254.

Other equipment carried by the slides 132 may be connected to the cable length 84*b*, for performing various other exercises against the resistance of the weights 60. For example, a press board, not illustrated, may be mounted between the horizontal equipment-supporting brackets 142, for performing leg presses, squats, and calf raises.

Figure 15:
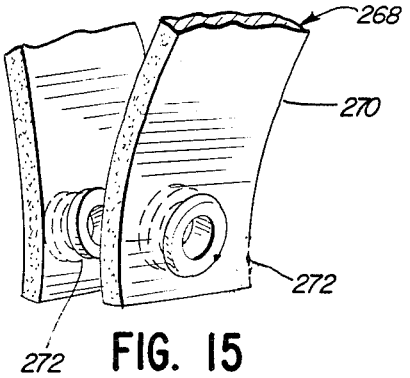
FIG. 15 is an enlarged detailed perspective view of the ends of a leg strap.

Referring to FIGS. 8 and 14, the dip bars 170 are used by grasping either the obliquely extending front portions 178 or the adjoining parallel rear portions 176 with the hands, supporting the body by the hands, arms and shoulders, and exercising the body while thus supported on the dip bars. For example, the user may be positioned with the body facing away from the frame 22, for doing leg raises, wherein the legs are swung up in front of the body as it is supported on the dip bars 170. In this case, the legs may be inserted through a pair of straps, such as the leg straps 268 illustrated in FIG. 14, which are connected to a pair of third cable lengths 84*c*, to impart weight resistance. As illustrated in FIG. 15, each strap includes a flat rectangular strap length 270 and a grommet 272 adjacent to each of the opposite ends of the strap. The third cable lengths 84*c* are connected to the leg straps 268 by the fasteners 90 at the ends of the lengths, inserted through the grommets 272. As another example, the user may face towards or away from the frame 22, and raise and lower the body, with or without weight resistance. Resistance may be provided by wearing a waist belt, not shown, and connecting the belt to the second cable length 84*b*' (FIG. 3) or the third cable length 84*c* (FIG. 1). Similarly, a waist belt may be worn and connected to a cable length for providing resistance when doing chin-ups on the chin bar 150.

FIG. 16 illustrates one arrangement for bench-pressing the barbell 230, loaded with the weights 232. In the illustrative arrangement, a padded bench or bench board 278 is supported at an outer end by legs 280 secured thereto. At the inner end of the bench 278, a cylindrical rod 282 is arranged to support the bench, with the rod held against longitudinal movement relative to the bench by fittings 284 or other suitable means, secured to the undersurface of the bench 278. The opposite end portions of the rod 282 are inserted between the legs 212, 213 of a pair of horizontally aligned parallel mounting brackets 208 on the uprights 32, as the brackets extend forwardly from the uprights. The barbell 230 is seated on the upper legs 212 of a pair of aligned mounting brackets 208, that are spaced above the bench 278.

In performing the bench press, the user lies down with his back on the bench 278, with his legs extending from the bench to the floor. While in that position, the user grasps the barbell 230, lifts it off of the brackets 208 on which it is seated, moves the barbell forwardly over his chest, and then lowers and raises the barbell one or more times, depending upon the type of workout. Then, with the user's arms extended and holding the barbell 230 in a raised position, the arms are rotated backwardly, towards the frame 22, and the barbell is lowered, to seat it once more on the upper legs 212 of the forwardly extending brackets 208 above the bench.

The stop means of the invention, as illustrated in FIGS. 9–11, perform an important safety function: They prevent the user from accidentally knocking one or both of the brackets 208 towards the uprights 32, so that the barbell 230 cannot be seated on the upper bracket legs 212. Should the brackets 208 be dislodged from their supporting positions, the user would have no place to seat the barbell, and would have to remove the barbell from above his body in some other manner, if no one else were present to assist him. This could lead to injury, especially where the total weight being lifted is at or near the user's maximum lifting strength. The stop means also prevent the brackets 208 from being pulled too far forwardly at any time.

The provision of the brackets 208 at various elevations on the front uprights 32 serves to support the bench 278 alternatively in incline and decline positions, wherein the bench is inclined downwardly and forwardly from the frame 22, and downwardly and rearwardly towards the frame, respectively. The supporting rod 282 for the inner end of the bench is moved to a higher pair of mounting brackets 208, to provide an incline bench, and to a lower pair of brackets 208, to provide a decline bench. For such purposes, the legs 280 may be pivotally connected to the bench 278, e.g., in a manner such as described in my aforesaid "Omnibod" publication.

The improvements of the present invention markedly increase the utility of the prior apparatus, and they also provide greater facility, effectiveness and safety in use. The illustrative uses of the several improvements are but a few of many uses, providing a wide range of exercises for the various body muscles. While preferred embodiments of the elements of the improved apparatus have been illustrated and described, it will be apparent to those skilled in the art that various changes and modifications may be made therein, within the spirit and scope of the invention. It is intended that all such changes and modifications be included within the scope of the appended claims.

I claim:

1. In body-building apparatus including an upstanding frame having a pair of spaced-apart front uprights, a pair of spaced-apart elongate arms extending forwardly from said frame adjacent to the top of the frame, and elongate support means extending forwardly from said frame adjacent to the bottom of the frame, the improvement comprising:

a chin bar;

means for mounting said chin bar on said arms adjustably in a selected one of a plurality of fixed positions along the length of the arms;

a pair of dip bars each including a rear portion, and a front portion extending angularly from the rear portion;

means for mounting said dip bars on said frame adjustably with said front portions each disposed in a selected one of at least two positions projected forwardly at different distances from said frame, said rear portions also projecting forwardly from said frame when said front portions are in at least one of their said positions, thereby to enable each bar to be manually gripped selectively on either of said portions;

a forward weight-cable pulley assembly;

means for mounting said pulley assembly on said support means adjustably in a selected one of a plurality of fixed positions along the length of the support means;

a plurality of equipment-supporting brackets disposed along each of said uprights, each of said brackets including a retainer and a pair of equipment-supporting legs extending laterally from the retainer and rearwardly with respect to the frame in vertically spaced-apart relation to each other, said legs of each bracket being reciprocally movable on an upright for corresponding movement of the bracket between a forwardly extending equipment-supporting position and a rearwardly retracted collapsed position, said retainer of each bracket including a first portion projecting upwardly from the uppermost one of the bracket legs for capturing a bar member seated on the uppermost leg between the retainer first portion and the front face of the upright on which the bracket is movable when the bracket is in said equipment-supporting position, and said retainer of each bracket including a second portion extending between the bracket legs for capturing a bar member seated on the lowermost leg between the retainer second portion and said front face of said upright and also between the bracket legs when the bracket is in said equipment-supporting position, and said retainer abutting on said front face of said upright when the bracket is in said collapsed position; and stop means associated with each of said leg pairs and its upright, for resisting said movement of the corresponding bracket either forwardly or rearwardly when in said equipment-supporting position.

2. In body-building apparatus including an upstanding frame, a pair of spaced-apart elongate arms extending forwardly from said frame adjacent to the top ofthe frame, elongate support means extending forwardly from said frame adjacent to the bottom of the frame, weight-cable pulley means mounted on said frame adjacent to the top of the frame, and weight-cable pulley means mounted on said frame adjacent to the bottom of the frame, the improvements comprising:

a chin bar;

means for mounting said chin bar on said arms adjustably in a selected one of a plurality of fixed positions along the length of the arms;

means on said chin bar for connecting the chin bar to cable means trained on said pulley means mounted adjacent to the top of the frame;

a forward weight-cable pulley assembly; and means for mounting said pulley assembly on said support means adjustably in a selected one of a plurality of fixed positions along the length of the support means, for receiving cable means trained on said pulley means mounted adjacent to the bottom of the frame.

3. In body-building apparatus including an upstanding frame, said frame including a pair of spaced-apart front uprights, and a pair of spaced-apart elongate arms extending forwardly from said frame adjacent to the top of the frame, the improvements comprising:

a chin bar;

means for mounting said chin bar on said arms adjustably in a selected one of a plurality of fixed positions along the length of the arms; and a plurality of equipment-supporting brackets disposed along each of said uprights, each of said brackets including a retainer and a pair of equipment-supporting legs extending laterally from the retainer and rearwardly with respect to the frame in vertically spaced-apart relation to each other, said legs of each bracket being reciprocally movable on an upright for corresponding movement of the bracket between a forwardly extending equipment-supporting position and a rearwardly retracted collapsed position, said retainer of each bracket including a first portion projecting upwardly from the uppermost one of the bracket legs for capturing a bar member seated on the uppermost leg between the retainer first portion and the front face of the upright on which the bracket is movable when the bracket is in said equipment-supporting position, and said retainer of each bracket including a second portion extending between the bracket legs for capturing a bar member seated on the lowermost leg between the retainer second portion and said front face of said upright and also between the bracket legs when the bracket is in said equipment-supporting position, and said retainer abutting on said front face of said upright when the bracket is in said collapsed position.

4. In apparatus as defined in claim 3 also including elongate support means extending forwardly from said frame adjacent to the bottom of the frame, the further improvement comprising:

a forward weight-cable pulley assembly; and means for mounting said pulley assembly on said support means adjustably in a selected one of a plurality of fixed positions along the length of the support means.

5. In apparatus as defined in claim 4, the further improvement comprising means on said chin bar for connecting the chin bar to weight-cable means.

6. In body-building apparatus including an upstanding frame having a pair of spaced-apart front uprights, the improvement comprising a plurality of equipment-supporting brackets disposed along each of said uprights, each of said brackets including a retainer and a pair of equipment-supporting legs extending laterally from the retainer and rearwardly with respect to the frame in vertically spaced-apart relation to each other, said legs of each bracket being reciprocally movable on an upright for corresponding movement of the bracket between a forwardly extending equipment-supporting position and a rearwardly retracted collapsed position, said retainer of each bracket including a first portion projecting upwardly from the uppermost one of the bracket legs for capturing a bar member seated on the uppermost leg between the retainer first portion and the front face of the upright on which the bracket is movable when the bracket is in said equipment-supporting position, and said retainer of each bracket including a second portion extending between the bracket legs for capturing a bar member seated on the lowermost leg between the retainer second portion and said front face of said upright and also between the bracket legs when the bracket is in said equipment-supporting position, and said retainer abutting on said front face of said upright when the bracket is in said collapsed position.

7. In apparatus as defined in claim 6, the further improvement comprising stop means associated with each of said leg pairs and its upright, for resisting said movement of the corresponding bracket either forwardly or rearwardly when in said equipment-supporting position.

8. In body-building apparatus including an upstanding frame, weight-cable pulley means mounted on said frame, and elongate support means extending forwardly from said frame adjacent to the bottom of the frame, the improvements comprising:

a pair of dip bars each including a rear portion, and a front portion extending angularly from the rear portion;

means for mounting said dip bars on said frame adjustably with said front portions each disposed in a selected one of at least two positions projecting forwardly at different distances from said frame, said rear portions also projecting forwardly from said frame when said front portions are in at least one of their said positions, thereby to enable each bar to be manually gripped selectively on either of said portions;

a forward weight-cable pulley assembly; and means for mounting said pulley assembly on said support means adjustably in a selected one of a plurality of fixed positions along the length of the support means, for receiving cable means trained on said pulley means.

9. In body-building apparatus including an upstanding frame having a pair of spaced-apart front uprights, a pair of spaced-apart elongate arms extending forwardly from said frame adjacent to the top of the frame, respective upper and lower weight-cable pulley means mounted on said frame, a pair of spaced-apart elongate supports extending forwardly from said frame adjacent to the bottom of the frame, a pair of slide rods extending upwardly from respective supports to respective arms adjacent to the front ends of the supports, and an equipment-carrying slide mounted on each rod, the improvement comprising:

a chin bar;

means for mounting said chin bar on said arms adjustably in a selected one of a plurality of fixed positions along the length of the arms;

means of said chin bar for connecting the chin bar to cable means trained on pulley means in the apparatus;

a pair of dip bars each including a rear portion, and a front portion extending angularly from the rear portion;

means for mounting said dip bars on respective ones of said uprights, adjustably with said front portions each disposed in a selected one of at least two positions projecting forwardly at different distances from said frame, said rear portions also projecting forwardly from said frame when said front portions are in at least one of their said positions, thereby to enable each bar to be manually gripped selectively on either of said portions;

a forward weight-cable pulley assembly;

means for mounting said pulley assembly on said supports adjustably in a selected one of a plurality of fixed positions along the length of the supports, for receiving cable means trained on said upper and lower pulley means, said pulley assembly mounting means being adapted for mounting the assembly in one of said positions being adjacent to said front ends of the supports, for connection of said cable means received thereon to equipment carried by said slides;

a plurality of equipment-supporting brackets disposed along each of said uprights, each of said brackets including a retainer and a pair of equipment-supporting legs extending laterally from the retainer and rearwardly with respect to the frame in vertically spaced-apart relation to each other, said legs of each bracket being reciprocally movable on an upright for corresponding movement of the bracket between a forwardly extending equipment-supporting position and a rearwardly retracted collapsed position, said retainer of each bracket including a first portion projecting upwardly from the uppermost one of the bracket legs for capturing a bar member seated on the uppermost leg between the retainer first portion and the front face of the upright on which the bracket is movable when the bracket is in said equipment-supporting position, and said retainer of each bracket including a second portion extending between the bracket legs for capturing a bar member seated on the lowermost leg between the retainer second portion and said front face of said upright and also between the bracket legs when the bracket is in said equipment-supporting position, and said retainer abutting on said front face of said upright when the bracket is in said collapsed position; and stop means associated with each of said leg pairs and its upright, for resisting said movement of the corresponding bracket either forwardly or rearwardly when in said equipment-supporting position.

* * * * *